US008758856B2

(12) United States Patent
Watanabe et al.

(10) Patent No.: US 8,758,856 B2
(45) Date of Patent: Jun. 24, 2014

(54) METHOD OF FLUORIDATION AND DIRECTIONS FOR USE OF A UNIT OF FLUORIDATION

(75) Inventors: Takanori Watanabe, Amagasaki (JP); Hideaki Iwamura, Amagasaki (JP); Katsuji Minami, Amagasaki (JP)

(73) Assignee: Air Water Inc. (JP)

( * ) Notice: Subject to any disclaimer, the term of this patent is extended or adjusted under 35 U.S.C. 154(b) by 621 days.

(21) Appl. No.: 13/062,271

(22) PCT Filed: Sep. 10, 2009

(86) PCT No.: PCT/JP2009/066208

§ 371 (c)(1), (2), (4) Date: Mar. 4, 2011

(87) PCT Pub. No.: WO2010/044329

PCT Pub. Date: Apr. 22, 2010

(65) Prior Publication Data

US 2011/0159184 A1 Jun. 30, 2011

(30) Foreign Application Priority Data

Oct. 16, 2008 (JP) ..... 2008-267634

(51) Int. Cl.
*C23C 16/28* (2006.01)

(52) U.S. Cl.
USPC ..... 427/255.17; 427/255.39

(58) Field of Classification Search
USPC ..... 427/255.17, 255.39
See application file for complete search history.

(56) References Cited

U.S. PATENT DOCUMENTS

| | | | | | |
|---|---|---|---|---|---|
| 4,604,170 | A | * | 8/1986 | Miyake et al. | 205/521 |
| 4,701,290 | A | * | 10/1987 | Eschwey et al. | 264/40.1 |
| 4,743,419 | A | * | 5/1988 | Bierschenk | 137/83 |
| 5,256,605 | A | * | 10/1993 | Oomen et al. | 501/57 |
| 6,000,341 | A | * | 12/1999 | Tung | 106/35 |
| 6,366,346 | B1 | * | 4/2002 | Nowak et al. | 356/72 |
| 2004/0006249 | A1 | * | 1/2004 | Hoshino et al. | 570/123 |
| 2007/0092441 | A1 | * | 4/2007 | Wadsworth et al. | 424/1.11 |

FOREIGN PATENT DOCUMENTS

| | | | | |
|---|---|---|---|---|
| JP | 02-263972 | A | | 10/1990 |
| JP | 06-283463 | A | | 10/1994 |
| JP | 09-157830 | A | | 6/1997 |
| JP | 2005-079123 | A | | 3/2005 |
| JP | 2007-27588 | | * | 2/2007 |
| JP | 2007-197822 | | * | 8/2007 |
| RU | 2181700 | | * | 7/2000 |
| WO | WO 00/34546 | A1 | | 6/2000 |
| WO | WO 2007-141529 | | * | 12/2007 |

OTHER PUBLICATIONS

International Preliminary Report on Patentability and Written Opinion of the International Searching Authority, PCT/JP2009/066209, issued May 17, 2011.

* cited by examiner

*Primary Examiner* — Bret Chen
(74) *Attorney, Agent, or Firm* — Wood, Phillips, Katz, Clark & Mortimer

(57) ABSTRACT

A method of fluoridation that can maintain a stable treatment quality is provided. The method of the fluoridation treatment performs the fluoridation treatment by heating and keeping a workpiece in a fluoridation treatment space filled with a predetermined fluoride atmosphere. By exposing an interior space structure that is reactive against fluorine within the fluoridation treatment space, forming a fluoride layer in advance on a surface of the interior space structure exposed within the fluoridation treatment space, and performing the fluoridation treatment, a fluoridation source gas supplied for the fluoridation treatment of the workpiece is not significantly consumed for fluoridating the surface of the interior space structure during the fluoridation treatment. Further, even when a fluoridation potential of the supplied fluoridation source gas is insufficient, the fluoride layer on the surface of the interior space structure discharges the fluoridation gas. Thereby, the fluoride atmosphere in the fluoridation treatment space during the fluoridation treatment can be appropriately maintained.

6 Claims, 6 Drawing Sheets

METHOD OF FLUORIDATION AND DIRECTIONS FOR USE OF A UNIT OF FLUORIDATION

TECHNICAL FIELD

The present invention relates to the method of fluoridation, the unit of fluoridation, and the directions for use of the unit of fluoridation for performing a fluoridation treatment on a workpiece which is a metallic material reactive with fluorine.

RELATED ART

At least a natural oxide film exists on surfaces of various metallic materials. For example, during a nitriding treatment performed to improve wear resistance and durability of a steel material, nitrogen and carbon atoms are impeded from penetrating a surface part of the steel material due to the existence of such an oxide film. Therefore, a process to remove such oxide film is necessary, especially prior to a gas nitriding treatment and a gas softnitriding treatment, and, as a method thereof, various methods have been proposed. As a highly productive method among those that are proposed, a method of removing the oxide film by heat, by utilizing halogen and/or halogenide, is disclosed and performed (for example, below listed Patent Documents 1, 2, 3 and 4).

By performing these treatments, even if a workpiece is, for example, a difficult-to-nitride material having a hard oxide film such as a stainless steel, it becomes possible to form a uniform nitride layer by the gas nitriding and the gas softnitriding which are performed afterwards.

Among the methods, a fluoridation treatment performed by utilizing fluorine and/or a fluoride compound substitutes the oxide film with a fluorinated film by forming fluoride which is more stable than oxide. Because the fluorinated film may be easily removed by reduction in a reducing atmosphere, the treatment is extremely suitable particularly as a pre-treatment for the gas nitriding treatment and the gas softnitriding treatment.

Further, the fluoridation treatment may be performed within the same kiln as the nitriding treatment. However, a method of, in which a separate kiln is used to perform the fluoridation, reducing a consumption of fluorine amount on an internal wall of a kiln so as to reduce the usage amount of fluoridation source gas, and a continuous kiln in which, by separating a fluoridation treatment compartment and a nitriding treatment compartment, not only the amount of fluoridation source gas is reduced but also a productivity is improved, are also disclosed (for example, below listed Patent Documents 5, 6 and 7).

Patent Document 1: JP 2,881,111
Patent Document 2: JP 06-299317(A)
Patent Document 3: JP 09-013122(A)
Patent Document 4: JP 3,643,882
Patent Document 5: JP 07-091628
Patent Document 6: JP 09-157830(A)
Patent Document 7: JP 2004-315868(A)

SUMMARY OF THE INVENTION

Problems to be Solved by the Invention

In the fluoridation treatment, it is essential to form a fluoride layer of a target thickness on a workpiece so as to form a uniform nitride layer. However, by using the methods and treatment kilns disclosed in the above Patent Documents, if the material and/or the quantity of the workpiece is changed even though the fluoridation treatment condition remains unchanged, the intended fluoride layer cannot be formed and, thus, a stable nitriding quality cannot be obtained continuously. Further, even when the fluoridation treatment condition is determined according to the material and quantity of the workpiece, there are cases where a target fluoridation quality cannot be achieved depending on the condition of the directly previous fluoridation treatment performed in the kiln. Further, it has become apparent that, because a high productivity of the nitride layer is emphasized more for the continuous kiln, a treatment time in each treatment compartment tends to become shorter, and the problem described above easily occurs on the continuous kiln.

Thus, in order to stably form the fluoride layer on the workpiece, at least for a heat treatment that performs fluoridation or a continuous kiln which has a fluoridation compartment, there is a need to disclose a continuous heat treatment kiln and a method of the heat treatment, which can consistently perform a production treatment more efficiently and stably in a short time.

The present invention made in view of the above situations, and has an object to provide the method of fluoridation, the unit of fluoridation, and the directions for use of the unit of fluoridation, which can keep a stable treatment quality.

Means for Solving the Problem

The inventor reached the present invention by finding that, through researching and examining the above described situations, the prescribed problems are not caused only by, for example, the change of the material and quantity of the workpiece, but also affected by the states of, for example, the kiln wall at the time of performing the fluoridation treatment of the workpiece.

In order to achieve the above objects, according to an aspect of the present invention, the method of fluoridation is provided, which performs a fluoridation treatment by heating and keeping a workpiece in a fluoridation treatment space filled with a predetermined fluoride atmosphere. The method includes exposing an interior space structure that is reactive against fluorine within the fluoridation treatment space, forming a fluoride layer in advance on a surface of the interior space structure exposed within the fluoridation treatment space, and performing the fluoridation treatment.

In order to achieve the above objects, according to another aspect of the present invention, the unit of fluoridation is provided, which performs a fluoridation treatment by heating and keeping a workpiece in a fluoridation treatment space filled with a predetermined fluoride atmosphere. The unit is configured so that the fluoridation treatment is performed in a state where an interior space structure that is reactive against fluorine is exposed within the fluoridation treatment space, and a fluoride layer is formed in advance on a surface of the interior space structure exposed within the fluoridation treatment space.

In order to achieve the above objects, according to another aspect of the present invention, the directions for use of the unit of fluoridation is provided, which performs a fluoridation treatment by heating and keeping a workpiece in a fluoridation treatment space filled with a predetermined fluoride atmosphere. The unit of fluoridation performs the fluoridation treatment in a state where an interior space structure that is reactive against fluorine is exposed within the fluoridation treatment space and a fluoride layer is formed in advance on a surface of the interior space structure exposed within the fluoridation treatment space. When a fluorine amount of the fluoride layer formed in advance on the surface of the interior space structure falls below a predetermined amount, the fluoride layer is restored by performing an auxiliary fluoridation treatment by heating and keeping inside the fluoridation treatment compartment with a predetermined atmosphere in a state where any workpiece does not exist therein.

Effect of the Invention

In the method of fluoridation according to the aspect of the invention, the interior space structure that is reactive against fluorine is exposed within the fluoridation treatment space, the fluoride layer is formed in advance on the surface of the interior space structure exposed within the fluoridation treatment space, and the fluoridation treatment if performed. Thus, the fluoride layer is formed on the surface of the interior space structure, therefore, a fluoridation source gas supplied for the fluoridation treatment of the workpiece is not excessively consumed for fluoridating the surface of the interior space structure during the fluoridation treatment. Further, even if a material and quantity of the workpiece are changed significantly depending on a lot and a situation where there is a deficiency of a fluoridation potential is caused, the fluoridation source gas is released from the fluoride layer on the surface of the interior space structure, and, therefore, the fluoride atmosphere within the fluoridation treatment space is maintained properly during the fluoridation treatment. Therefore, a stable fluoridation quality can be obtained when performing the fluoridation treatment on various lots. Especially, further in a continuous kiln which tends to have a shorter treatment time, it is possible to achieve a treatment with a stable fluoridation quality. Further, even when a quantity of treatment of the workpiece having a strong oxide film, such as a stainless steel and the like, changes significantly, the oxide film is unfailingly removed and the fluoride layer can be formed with a targeted fluoridation quality. Therefore, a uniform treatment layer can be formed when, for example, performing a nitriding treatment or a low-temperature carburization treatment as a post-treatment.

In the method of fluoridation according to the aspect of the invention, the fluoride layer formed on the surface of the interior space structure in advance may have the thickness of 1.3 μm or thicker in a portion where its fluorine concentration is 5 mass % or higher. Due to the fluoride layer being in a state where a growth rate is decreased because a reaction rate control is finished and a diffusion rate control is started, the fluoridation source gas can be less consumed by the surface of the interior space structure when the fluoridation treatment is performed afterwards. Further, because the above described fluoride layer holds a sufficient amount of fluorine, a sufficient amount of fluoridation source gas can be released when the potential of the fluoride atmosphere becomes low. Thus, even when fluoridation treatment is performed on various lots, a stable fluoridation quality can be obtained.

In the method of fluoridation according to the aspect of the invention, the fluoride layer formed at least in a section of the surface of interior space structure where its temperature becomes higher than the workpiece during the fluoridation treatment may have a thickness of 1.3 μm or thicker in a portion where its fluorine concentration is 5 mass % or higher. Thereby, it may further be beneficial to a stabilization of the fluoridation quality due to a stabilization of the fluoride atmosphere. That is, at the section where its temperature becomes higher than the workpiece, although a fluoridation reaction consuming the fluoridation source gas in the fluoride atmosphere tends to proceed, a release of the fluoridation source gas due to a decomposition of the fluoride layer when the potential of the fluoride atmosphere becomes low tends to occur. Therefore, by forming the fluoride layer in the section where the temperature becomes higher than the workpiece, the fluoridation source gas consumed by the surface of the interior space structure can be reduced, and the effect on stabilizing the fluoride atmosphere can be more noticeably obtained due to the fluoridation source gas being released when the potential of the fluoride atmosphere becomes low.

The unit of fluoridation according to the aspect of the invention is configured so that the fluoridation treatment is performed in the state where the interior space structure that is reactive against fluorine is exposed within the fluoridation treatment space, and the fluoride layer is formed in advance on the surface of the interior space structure exposed within the fluoridation treatment space. Thus, the fluoride layer is formed on the surface of the interior space structure in advance, therefore the fluoridation source gas supplied for the fluoridation treatment of the workpiece is not excessively consumed for fluoridating the surface of the interior space structure during the fluoridation treatment. Further, even if a material and quantity of the workpiece are changed significantly depending on a lot and causes a situation where there is a deficiency of a fluoridation potential of the supplied fluoridation source gas, the fluoridation source gas is released from the fluoride layer on the surface of the interior space structure, and, therefore, the fluoride atmosphere within the fluoridation treatment space is maintained properly during the fluoridation treatment. Thus a stable fluoridation quality can be obtained when performing the fluoridation treatment on various lots. Especially, further in a continuous kiln which tends to have a shorter treatment time, a treatment with a stable fluoridation quality can be achieved. Further, even when a quantity of treatment of the workpiece having a strong oxide film, such as a stainless steel, and the like changes significantly, the oxide film is unfailingly removed and the fluoride layer can be formed with a targeted fluoridation quality. Therefore, a uniform hardened layer can be formed when, for example, performing a nitriding treatment or a low-temperature carburization as a post-treatment.

The unit of fluoridation according to the aspect of the invention may further include a post-treatment space where the post-treatment is performed after the fluoridation treatment. The fluoridation treatment space may exist independently from the post-treatment space and may be provided with a transporting module for transporting the workpiece from the fluoridation treatment compartment to the post-treatment compartment. Therefore, the fluoridation source gas consumption by the surface of the interior space structure may be suppressed, and also the stability of the fluoride atmosphere due to releasing of the fluoridation source gas when the potential of the fluoride atmosphere becomes low may not be affected and disturbed by the existence of the post-treatment space. Further, because the workpiece travels from the pre-heated fluoridation treatment compartment to the post-treatment compartment, the time required to raise the temperature of the workpiece in each treatment compartment can be reduced, and, in addition, a highly productive mass production treatment with a stable post-treatment quality can be performed even with a short treatment time.

In the unit of fluoridation according to the aspect of the invention, the fluoridation treatment compartment may be formed in a cylindrical shape with its axis oriented along a transporting direction of the workpiece. Therefore, the fluoridation source gas may circulate well within the fluoridation treatment space, and the atmosphere gas circulating within the fluoridation treatment space may effectively prevent uneven distribution of the fluoridation source gas within the space even when a small amount of fluoridation source gas is consumed by the surface of the interior space structure. Further, the atmosphere gas circulating within the fluoridation treatment space may effectively prevent uneven distribution of the fluoridation source gas within the space when a potential of the fluoride atmosphere becomes low and the fluoridation source gas is released. Thereby the fluoride atmosphere within the fluoridation treatment space can be homogenized and an effect on stabilizing the fluoridation treatment condition can be more noticeably obtained. Further, a gas convection flow which significantly affects the temperature variation within the fluoridation treatment space occurs distinctly smoothly, and a variation of a gas concentration within the fluoridation treatment space becomes extremely small, thus, a variation of fluoridation quality at a location within the fluoridation treatment space can be significantly reduced.

In the directions for use of the unit of fluoridation according to the aspect of the invention, the unit of fluoridation performs the fluoridation treatment in the state where the interior space structure that is reactive against fluorine is exposed within the fluoridation treatment space and the fluoride layer is formed in advance on the surface of the interior space structure exposed within the fluoridation treatment space. Thus, the fluoride layer is formed on the surface of the interior space structure in advance, therefore the fluoridation source gas supplied for the fluoridation treatment of the workpiece is not excessively consumed for fluoridating the surfaces of the interior space structure during the fluoridation treatment. Further, even if a material and quantity of the workpiece are changed significantly depending on a lot and a situation where there is a deficiency of a fluoridation potential of the fluoridation source gas is caused, the fluoridation source gas is released from the fluoride layer on the surface of the interior space structure, and, therefore, the fluoride atmosphere within the fluoridation treatment space is maintained properly during the fluoridation treatment. Thus a stable fluoridation quality can be obtained when performing the fluoridation treatment on various lots. Especially, further in a continuous kiln which tends to have a shorter treatment time, a treatment with a stable fluoridation quality can be achieved. Further, even when a quantity of treatment of the workpiece having a strong oxide film, such as a stainless steel, and the like changes significantly, the oxide film is unfailingly removed and the fluoridation layer can be formed with a targeted of fluoridation quality. Therefore, a uniform hardened layer can be formed when, for example, performing a nitriding treatment or a low-temperature carburization as a post-treatment.

Further, when the fluorine amount within the fluoride layer formed in advance on the surface of the interior space structure falls below the predetermined amount, the fluoride layer is restored by performing the auxiliary fluoridation treatment by heating and keeping inside the fluoridation treatment space with the predetermined fluoride atmosphere. Therefore, when the fluorine amount within the fluoride layer falls below the predetermined amount, and its effect of maintaining the atmosphere by suppressing consumption of the fluoridation source gas on the surface of the interior space structure and by releasing the fluoridation source gas when the potential of the atmosphere becomes low is decreased, the effect of maintaining the atmosphere can be restored by restoring the fluoride layer through the auxiliary fluoridation treatment. For example, when the fluoridation treatment is performed in a state where the fluoridation source gas is supplied by an amount significantly less than the appropriate amount, the fluorine amount of the fluoride layer is reduced because a large amount of fluoridation source gas is discharged from the surface of the interior space structure exposed within the fluoridation treatment space. In such case, the state where the targeted fluoride layer can be stably formed on the workpiece can be recovered by restoring the fluoride layer through the auxiliary fluoridation treatment.

In the directions for use of the unit of fluoridation according to the aspect of the invention, a test piece made of the same material as a material constituting the surface of the interior space structure is arranged within the fluoridation treatment space, and, after the fluoridation treatment is performed repeatedly, the fluorine amount of the fluoride layer formed on the surface of the interior space structure may be detected based on a state of the test piece. Therefore, the state of the fluoride layer in which the fluorine amount falls below a predetermined amount and an effect of maintaining the atmosphere by suppressing consumption of the fluoridation source gas on the surface of the interior space structure and releasing the fluoridation source gas when the potential of the atmosphere becomes low is decreased may be detected based on the state of the test piece, and thus, the state of the fluoride layer formed on the interior structure of the treatment space can be accurately grasped. Therefore, the auxiliary fluoridation treatment for restoring the fluoride layer can be performed at an appropriate timing, and the effect of maintaining the atmosphere can be maintained. Further, by handling the quality problems of the workpiece such as incomplete fluoridation before they occur, a further stable production treatment can be performed.

BEST MODE FOR CARRYING OUT THE INVENTION

Figure 1:
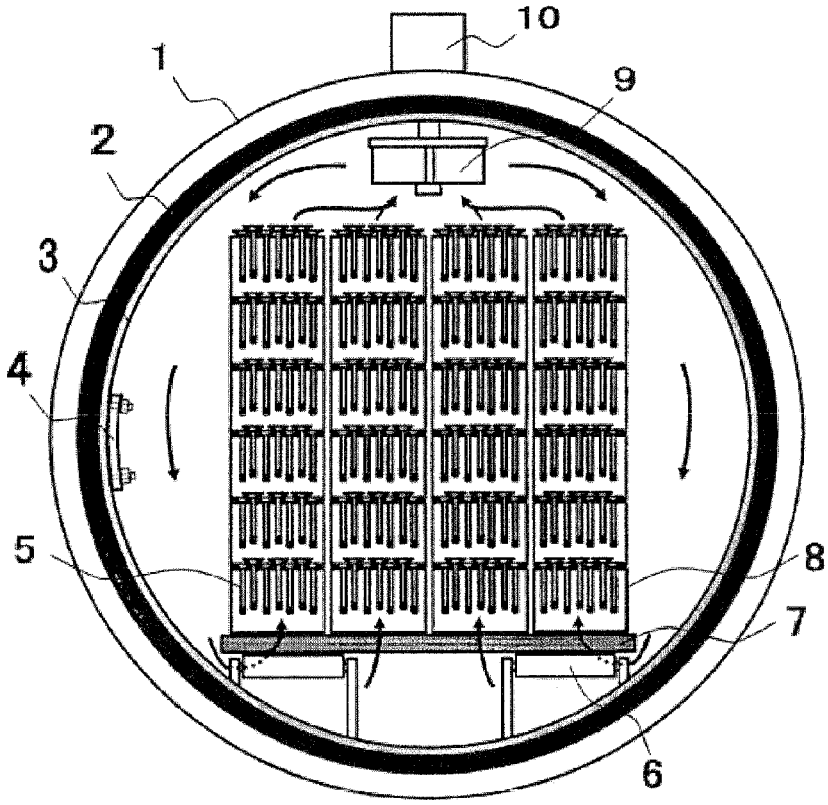
FIG. 1 is a schematic diagram illustrating a cross-sectional structure of the unit of fluoridation according to one embodiment of the present invention.

Next, the best mode for implementing the method of fluoridation, the unit of fluoridation, and the directions for use of the unit of fluoridation are described.

The method of fluoridation of the embodiment performs the fluoridation treatment by keeping and heating a workpiece in a fluoridation treatment space filled with a predetermined fluoridation atmosphere. An interior space structure that is reactive against fluorine is exposed within the fluoridation treatment space, a fluoride layer is formed in advance on a surface of the interior space structure, and the fluoridation treatment is performed.

The workpiece is composed of a metallic material that is reactive against fluorine and can be fluoride-treated for which various ferrous metals as well as other metals such as Ti and Al, and their alloy Ti—Al type alloys, and various non-ferrous metals which are reactive against fluorine may be used.

In the present invention, a uniform fluoride layer can be formed stably on these materials.

Further, a post-treatment can be performed following the fluoridation treatment. As such post-treatment, various surface treatments can be listed such as a nitriding treatment, a carburizing treatment, a nitrocarburizing treatment, a sulfarizing treatment, and a sulphonitriding treatment. By forming the uniform fluoride layer through the fluoridation treatment, a uniform post-treatment layer can be formed stably.

When the nitriding treatment is performed as the post-treatment, as a material to be treated, various steels can be listed such as a carbon steel, a low-alloy steel, a high-alloy steel, a structural rolled steel, a high-tensile steel, a machine structural steel, a carbon tool steel, an alloy tool steel, a high speed tool steel, a bearing steel, a spring steel, a case-hardened steel, a nitride steel, a stainless steel, and a heat-resistant steel. A uniform nitride layer can be stably formed by forming the uniform fluoride layer through the above described fluoridation treatment on the above listed materials.

In this embodiment, the interior space structure that is reactive against fluorine is exposed within the fluoridation treatment space of the unit of fluoridation.

As a material constituting a surface of the interior space structure of the treatment space, a material that is reactive against fluorine and is a metallic material having catalytic effect which at least decomposes a fluoridation source gas and promotes the fluoridation reaction. The metallic material constituting the surface of the interior space structure of the treatment space needs to have a high tolerance against high temperature, and preferably have resistance against oxidation and corrosion to some extent considering that the material will go through repeated treatments of fluoridation. Therefore, an austenite stainless steel, an austenite heat-resistant steel, and a corrosion and heat resistant steel containing at least 20 mass %, preferably 30 mass % or higher of nickel, can be appropriately utilized.

The fluoridation treatment is performed by introducing to the fluoridation treatment space with the fluoridation source gas, such as an $NF_3$ gas, containing fluorine and/or a fluorine compound so as to form a fluoridation atmosphere, keeping the workpiece heated at 200 to 600° C. for a predetermined time frame in the fluoridation atmosphere, removing an oxide film on the surface of the workpiece, and forming the fluoride layer as a result.

In this embodiment, the fluoridation treatment is performed in a condition where the fluoride layer is formed on the surface of the interior space structure exposed within the fluoridation treatment space in advance.

The fluoride layer is formed on the entire surface of the interior space structure exposed within the fluoridation treatment space.

The fluoride layer is formed by, prior to the fluoridation treatment for the workpiece, introducing to the fluoridation treatment space with the fluoridation atmosphere, the fluoridation source gas, such as the $NF_3$ gas, containing fluorine and/or the fluorine compound, and keeping the treatment space heated at 200 to 600° C. for the predetermined time frame to remove the oxide film on the surface of the interior space structure exposed within the fluoridation treatment space and form the fluoride layer as a result.

In this embodiment, the fluoride layer formed on the surface of the internal structure in advance is preferred to have a thickness of 1.3 μm or thicker in a portion where a fluorine concentration is 5 mass % or higher. Because, when the thickness is less than 1.3 μm at the portion where the fluorine concentration is equal to and higher than 5 mass %, the fluoride layer may not be completed with a reaction rate controlling stage, and therefore, the fluoridation source gas may be consumed by the surface of the interior space structure when the fluoridation treatment is performed afterwards. Further, it is because the fluoride layer does not contain a sufficient fluorine amount, the fluoride layer cannot release a sufficient amount of fluoridation source gas when the potential of the fluoridation atmosphere becomes low.

Further, in this embodiment, the fluoride layer formed at least in a section where its temperature becomes higher than the workpiece during the fluoridation treatment is preferred to have a thickness of 1.3 μm or thicker in a portion where the fluorine concentration is 5 mass % or higher. That is, the fluoride layer is preferred to be formed so that the fluoride layer formed in the section where its temperature becomes higher than the workpiece during the fluoridation treatment, the thickness of 1.3 μm or thicker in the portion where the fluorine concentration is 5 mass % or higher. Because if the fluoride layer formed in the section where its temperature becomes higher than the workpiece during the fluoridation treatment has the thickness of less than 1.3 μm in the portion where the fluorine concentration is 5 mass % or higher, the consumption of the fluoridation source gas on the surface of the interior space structure of the treatment space is reduced and an effect to stabilize the fluoridation atmosphere by releasing the fluoridation source gas when the potential of the fluoridation atmosphere becomes low cannot be obtained.

If the nitriding treatment is performed as the post-treatment following the fluoridation treatment, the workpiece, on which the fluoride layer is formed by the fluoridation treatment, is heated to reach at 350 to 650° C. and kept within the atmosphere containing the $NH_3$ gas for a predetermined time frame, and thereby, the fluoride layer on the surface of the steel material, which is the workpiece, is decomposed and the nitride layer is formed by being defuse-coated with nitrogen atoms on the active surface.

The fluoridation treatment and the post-treatment can utilize the same fluoridation treatment compartment by performing the fluoridation treatment followed by the post-treatment, or, after performing the fluoridation treatment in the fluoridation treatment compartment, the post-treatment can be performed in a post-treatment compartment provided independently from the fluoridation treatment compartment.

Here, if the nitriding treatment is performed as the post-treatment, when the fluoridation treatment and the nitriding treatment are performed in the same treatment compartment, the fluoride layer formed on the surface of the interior space structure in advance is decomposed by performing the nitriding treatment. Therefore the nitriding treatment is preferred to be performed in a nitriding treatment compartment which exists independently from the fluoridation treatment compartment.

In this way, because the fluoride layer is previously formed on the interior structure surface of the treatment compartment where the fluoridation treatment is performed, the amount of the fluoridation source gas, which is supplied for the fluoridation treatment on the workpieces, to be consumed by the interior structure surface, such as a kiln wall, is reduced. Thus, there is an advantage that the supply amount of the fluoridation source gas can be reduced, and the fluoridation layer of the target thickness on the workpiece can be formed more stably. In regard to a unit structure of the heat treatment kiln which is the unit of fluoridation here, the unit may have both the fluoridation treatment compartment and the nitriding treatment compartment coexisting in a single kiln body, such as a continuous kiln, or the unit may have a kiln body for the fluoridation treatment compartment and another kiln body for the nitriding treatment compartment.

By performing the fluoridation treatment, the fluoridation reaction progresses not only on the surface of the workpiece, but on the surface of the interior space structure in, for example, the kiln wall where the fluoridation treatment is performed. This is because the interior space structure such as the kiln wall needs to contain the metallic material having the catalytic effect for promoting the fluoridation reaction by decomposing the fluoridation source gas, and thus the metallic material reacts with fluorine.

Here, because the interior space structure such as the kiln wall is closer than the workpiece to a heat source for raising the temperature inside the kiln, if both of the surfaces of the workpiece and the interior space structure are in a condition where the fluoride layer is virtually non-existent (the fluoride layer is not formed adequately), the fluoridation reaction preferentially occur on the surface of interior structure such as the kiln wall of a high temperature. As such, when the surface of the interior space structure does not have the adequate fluoride layer thickness formed, the amount of the fluoridation source gas consumed by the fluoridation reaction on the interior space structure surface becomes large, and the adequate potential of the fluoridation source gas to form the fluoride layer of the target thickness on the workpiece cannot be obtained, and thus, causing a substandard fluoridation quality on the workpiece.

Therefore, according to this embodiment, in prior to the fluoridation treatment on the workpiece, by forming the fluoride layer of the adequate thickness on the surface of the interior space structure exposed within the fluoridation treatment space in advance, the fluoridation reaction on the surface of the interior space structure can be suppressed, and, thereby, the amount the fluoridation source gas consumed by the reaction here is reduced, and the stable fluoridation treatment on the workpiece can be performed.

On the other hand, by having the fluoride layer of the adequate thickness formed on the surface of interior space structure exposed within the fluoridation treatment space, even when, for example, the introducing amount of the fluoridation source gas such as the $NF_3$ gas is slightly inadequate relative to the input quantity of workpiece, the decomposing reaction of the fluoride occurs in the fluoride layer formed on the surface of the interior space structure, and the release of the fluoridation source gas within the fluoridation treatment space occurs. Because the fluoridation source gas released here contributes to the fluoridation reaction on the workpiece, by having the fluoride layer of the adequate thickness formed on the surface of the interior space structure, the more stable fluoridation treatment can be performed.

The fluoride layer formed on the surface of the interior space structure exposed within the fluoridation treatment space in advance is preferred to have the thickness of 1.3 μm or thicker in the portion where the fluorine concentration is 5 mass % or higher. In this way, the stable fluoridation treatment becomes possible even when lots of the workpiece which vary significantly in the material and the quantity from one lot to another are treated continuously.

That is, in the initial stage, the fluoridation reaction causes formation of the fluoride layer by a reaction rate control, then progresses to a diffusion rate control. In the stage of the reaction rate control where the fluoride layer does not reach a certain level of thickness, the growth rate of the fluoride layer is fast, and the consumption of the fluoridation source gas is also high. In contrast, in the stage of the diffusion rate control which is after the fluoride layer grows to the certain level of thickness, the growth rate of the fluoride layer, the reaction speed that is, becomes significantly slower, and the consumption of the fluoridation source gas is also small.

Thus, in this embodiment, by forming the fluoride layer formed in advance on the surface of the interior space structure exposed within the fluoridation treatment space to have the thickness of 1.3 μm or thicker in the portion where the fluorine concentration is 5 mass % or higher, the adequate fluoride layer is formed on the surface of the interior space structure, and thus giving the priority of reaction to the workpiece.

Including cases where the surface fluorine concentration of the fluoride layer is less than 5 mass %, or where the thickness of the entire fluoride layer is less than 1.3 μm, when the fluoride layer formed on the surface of interior space structure exposed within the fluoridation treatment space in advance has the thickness of less than 1.3 μm in the portion where the fluorine concentration is 5 mass % or higher, as described previously, the fluoridation reaction preferentially progresses on the surface of the interior space structure of a higher temperature, and a large amount of fluoridation source gas is consumed by the surface of interior space structure. Thereby, a shortage of the fluoridation source gas occurs for the fluoridation reaction of the workpiece, the fluoridation treatment on the workpiece becomes inadequate, and as a result, the treatment quality of the following post-treatment such as the nitriding treatment is negatively affected.

The phenomenon such as this may possibly occur in a single compartment type kiln dedicated for fluoridation. However, the phenomenon tends to occur more in a continuous treatment unit further including a post-treatment space where the post-treatment is performed after the fluoridation treatment, in which the fluoridation treatment space exists independently from the post-treatment space and which is provided with a transporting module of transporting the workpiece from the fluoridation treatment compartment to the post-treatment compartment to perform the fluoridation treatment and the post-treatment continuously. This is mainly because, with the continuous treatment unit, each treatment time within each treatment compartment tends to be short because of considerations for a productivity, and thereby the fluoridation reaction time becomes shorter to cause a state where the fluoridation treatment of the workpiece is also inadequate, and as a result, affecting negatively on the treatment quality of the following post-treatment such as the nitriding treatment.

Thus, by utilizing the continuous treatment unit including the fluoridation treatment compartment where the fluoride layer in which the thickness of the portion where the fluorine concentration is 5 mass % or higher is 1.3 μm or thicker is formed on the surface of the interior space structure such as a furnace wall, the stable fluoridation treatment is possible even when the lots of the workpiece which vary significantly in quantity and material from one lot to another are treated continuously. Therefore, a highly productive mass production treatment with a stable post-treatment quality, in which the stable quality post-treatment layer can be formed in the following post-treatment performed in the post-treatment compartment, such as the nitriding treatment compartment.

In the continuous treatment unit described above, it is preferred that at least the fluoridation treatment compartment has its space shaped into a cylindrical shape with its axis parallel with the transporting direction of the workpiece. In this way, a convectional flow of the fluoridation source gas becomes smooth within the kiln, and the temperature variation within the fluoridation treatment space becomes small and, further, the variation of the concentration of the fluoridation source gas in the kiln becomes small where the decomposition and the reaction speed are relatively high, thus, a further uniform fluoride layer can be formed.

Further, it is also preferred for the post-treatment compartment, such as the nitriding treatment compartment, to have a space shaped in a cylindrical shape with its axis parallel with the transporting direction of the workpiece. In this way, a convectional flow of the post-treatment gas such as a nitriding supply gas, for example $NH_3$, within the post-treatment space becomes smooth, and the temperature and the gas concentration variation within the post-treatment space becomes small, and thus, a further uniform formation of the post-treatment layer can be formed.

In the directions for use of the unit of fluoridation of this embodiment, when the fluorine amount in the fluoride layer formed on the surface of the interior space structure in advance falls below a predetermined amount, an auxiliary fluoridation treatment by keeping and heating the fluoridation treatment space in a predetermined fluoridation atmosphere is performed to restore the fluoride layer.

That is, as described above, while reducing the amount of the fluoridation source gas consumed by the fluoridation reaction on the surface of the interior space structure, the fluoride layer on the surface of the interior space structure exposed within the fluoridation treatment space needs to be in the condition where it contains a sufficient amount of fluorine in order to release the fluoridation source gas to stabilize the fluoridation quality when the fluoride potential of the fluoridation atmosphere becomes low. Thus, when the fluorine amount in the fluoride layer formed in advance falls below the predetermined amount, the fluoride layer is restored by performing the auxiliary fluoridation treatment.

Here, in order to perform the stable fluoridation treatment, it is necessary to have a reasonably accurate grasp of the fluoride layer thickness on the surface of the interior space structure exposed within the fluoridation treatment space. Therefore, it is preferred that a test piece made of the same material as the surface of the interior space structure is arranged within the fluoridation treatment space. Then the fluorine amount of the fluoride layer, which is formed on the surface of the interior space structure after the fluoridation treatment is repeatedly performed, is detected based on the condition of the test piece.

For example, a test piece made of the same material as the surface of the interior space structure is prepared and detachably arranged on, for example, the kiln wall. By detaching the test piece and measuring the thickness of the fluoride layer of the test piece at a predetermined timing, the fluorine amount of the fluoride layer formed on the surface of the interior space structure is detected. The thickness of the fluoride layer can be easily measured by utilizing, for example, a glow discharge optical emission spectrometer (GD-OES), and therefore can estimate the thickness of the fluoride layer on the surface of the interior space structure. Note that, it is further preferred that the test piece has the equivalent surface roughness as the surface of interior space structure in addition to being made of the same material as that of the surface of the interior space structure, because, thereby, the thickness of the fluoride layer can be grasped more accurately.

Further, when the fluoride layer on the surface of the interior space structure measured as above has the thickness of less than 1.3 μm in the portion where the fluorine concentration is 5 mass % or higher, even when the fluoridation treatment on the workpiece is performed with normally appropriate conditions of, such as, a temperature, a time, and a gas supply amount, the normal fluoridation treatment may not be performed. Therefore, for example, by performing the auxiliary fluoridation treatment without any workpiece loaded, or performing the auxiliary fluoridation treatment set with only a jig or with a jig loaded with a treated test piece or a substandard non-treated piece, the fluoride layer thickness of the portion where the fluorine concentration is 5 mass % or higher can be obtained.

Here, the fluoridation source gas such as the $NF_3$ gas has tendency to decompose and react in a shorter time frame due to the catalytic effect on the metallic surface, therefore it is more desirable to perform the auxiliary fluoridation treatment in a state where some type of workpiece is loaded, because it can generate a large amount of active fluorine and promote the reaction on the surface of the interior space structure.

Example 1

Next, examples according to the present invention are described.

FIG. 1 illustrates a cross-sectional diagram of one example of the unit of fluoridation of this embodiment.

This example shows a fluoridation treatment kiln dedicated for a fluoridation treatment, in which a fluoridation treatment and a post-treatment such as a nitriding treatment are performed in different treatment spaces.

In this fluoridation treatment kiln, a heater 2 is arranged in an inner surface part of a kiln body 1, and an inner part of a wall 3 as an inner-kiln structure which is an interior space structure arranged on the inner side of the heater 2 is a fluoridation treatment space. By utilizing the heater 2 and generating inside the fluoridation treatment space, by a stirring fan 9, a convectional gas flow indicated by arrows, the temperature within the kiln can be properly adjusted. On the inside surface of the kiln wall 3 exposed within the fluoridation treatment space, a test piece 4 for verifying the kiln wall state, and made of the same material as the kiln wall 3 having the comparable surface roughness by having the similar surface finish as an inner surface of the kiln wall 3 is detachably attached.

Further, although not illustrated, the kiln body 1 includes a gas supply piping for introducing an atmosphere gas for the fluoridation treatment into the fluoridation treatment space, and a gas exhaust piping for exhausting the atmosphere gas within the fluoridation treatment space. Moreover, in the figure, the reference numeral 10 is a stirring fan motor 10 for driving the kiln inside gas stirring fan 9, and the reference numeral 6 is a roller 6 for transportation.

In the example, the fluoridation treatment is performed by arranging a workpiece 5 within the treatment space, raising the temperature to a predetermined fluoridation temperature, and further introducing into the treatment space the fluoridation treatment atmosphere gas containing $NF_3$ to keep it heated. Thereby the surface of the test piece 4 is exposed to the similar gas atmosphere and becomes the similar state in temperature as the inner surface of the kiln wall 3, thus, by conforming the surface state of the test piece 4, the state of the inside surface of the kiln wall 3 can be grasped fairly accurately.

In the example, a fluoridation treatment kiln is prepared, in which an SUS304 material is used as a material for the kiln wall 3 and a material for the test piece 4, and as illustrated in FIG. 1, the test piece 4 is attached in such a way that it contacts the inner surface of the kiln wall 3.

By utilizing this fluoridation treatment kiln, an auxiliary fluoridation treatment is performed, in a state where the kiln is not loaded with any workpiece, by substituting the interior gas of the kiln with the $N_2$ gas, raising the kiln temperature to 350° C., and keeping it for 120 minutes in the atmosphere containing 1 vol. % of $NF_3$ gas.

Here, the surface of the test piece 4 made of the SUS304 material adhered to the kiln wall 3 is analyzed. A fluoride layer containing a fluorine concentration of 5 mass % or higher with a thickness of 0.7 μm is formed on the surface.

As a comparative example, a fluoridation treatment is performed, in which engine valves 5 as workpieces used with a SUH35 material which is a heat resistant steel are placed in heat treatment jigs 8 and loaded on a transportation tray 7 as illustrated in FIG. 1, the interior gas of the kiln is substituted with $N_2$, the kiln temperature is raised to 350° C., and the engine valves are kept for 60 minutes in an atmosphere containing 3 vol. % of $NF_3$ gas. The workpieces after the fluoridation treatment are then transported to the nitriding treatment kiln to be performed the nitriding treatment by substituting the interior gas of the kiln with the $N_2$ gas and keeping the kiln at 570° C. for 30 minutes in an atmosphere of 50 vol. % of $NH_3$ gas and 50 vol. % of RX gas. Note that the RX gas is a reformed gas of methane gas, propane gas, and butane gas, and is a mixed gas comprised mainly of $N_2$ gas, $H_2$ gas, and CO gas.

In the test piece 4 after the fluoridation treatment, a thickness of a surface fluoride layer containing the fluorine concentration of 5 mass % or higher is analyzed, and the thickness is 1.8 μm. While the thickness prior to the fluoridation treatment in the comparative example is 0.7 μm, the thickness prior to the fluoridation treatment in an example A (that is, after the fluoridation treatment in the comparative example) is significantly increased to 1.8 μm.

As the example A, a fluoridation treatment is performed, in which, utilizing this fluoridation treatment kiln while the engine valves as the workpieces are in the same state as the comparative example in material and quantity, the engine valves are kept at 350° C. in the atmosphere containing 1 vol. % of $NF_3$ gas for 60 minutes, then followed by the nitriding treatment performed in the same nitriding kiln in the same condition as the comparative example.

Figure 2:
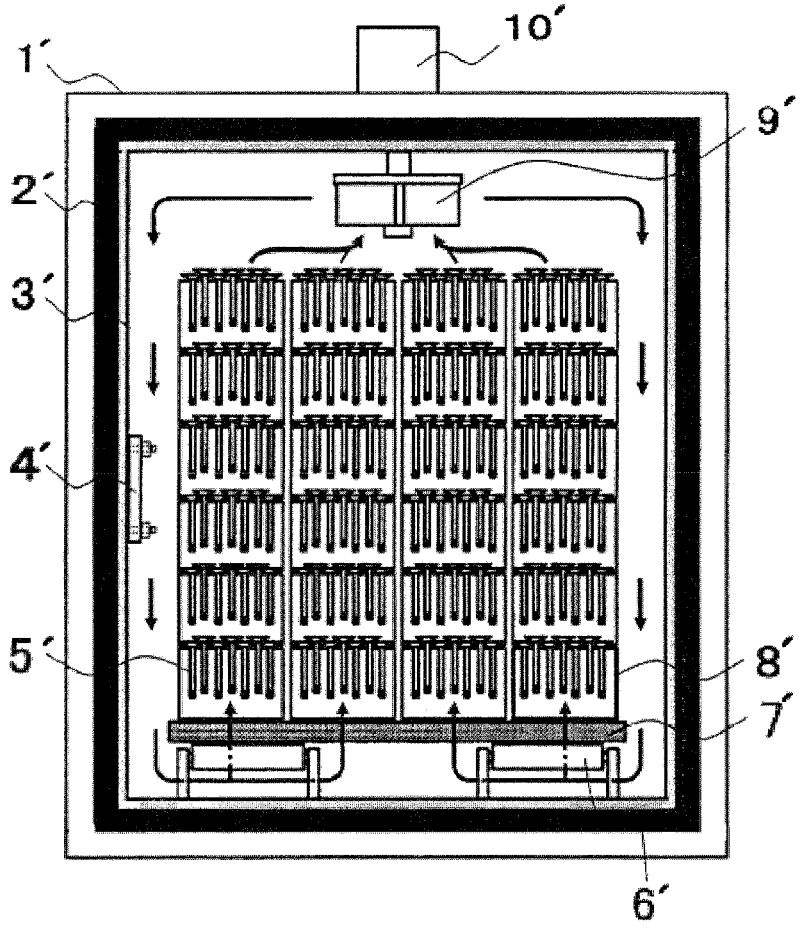
FIG. 2 is a schematic diagram illustrating a cross-sectional structure of the unit of fluoridation according to another embodiment of the present invention.

FIG. 2 is a diagram illustrating a cross-sectional diagram of one example of another fluoridation treatment kiln.

In comparison to the fluoridation treatment kiln having a cross-section of an approximately circular shape as illustrated in FIG. 1, the fluoridation treatment kiln in this example has a cross-section of an approximately square shape. Other than that, the kiln has the similar basic unit configuration with the one illustrated in FIG. 1. Further, also in the fluoridation treatment kiln in this example, the SUS304 material is also used as a material of a kiln wall 3' and a material of a test piece 4' and the similar surface finish is performed so that both have the nearly equivalent surface roughness.

Utilizing this fluoridation treatment kiln, by performing an auxiliary fluoridation treatment in which the kiln is kept at 350° C. in an atmosphere containing 10 vol. % of $NF_3$ gas for 180 minutes, it is confirmed that, in the test piece 4, the thickness of the surface fluoride layer having an F concentration of 5 mass % or higher has reached approximately 2.0 μm.

As an example B, after performing the auxiliary fluoridation treatment, the fluoridation treatment is performed under the same condition as the example A while the engine valves as the workpieces are kept in the same state as the comparative example and the example A in material and quantity. Then, the nitriding treatment is performed in the same nitriding kiln in the same state as the comparative example and the example A.

Figure 3:
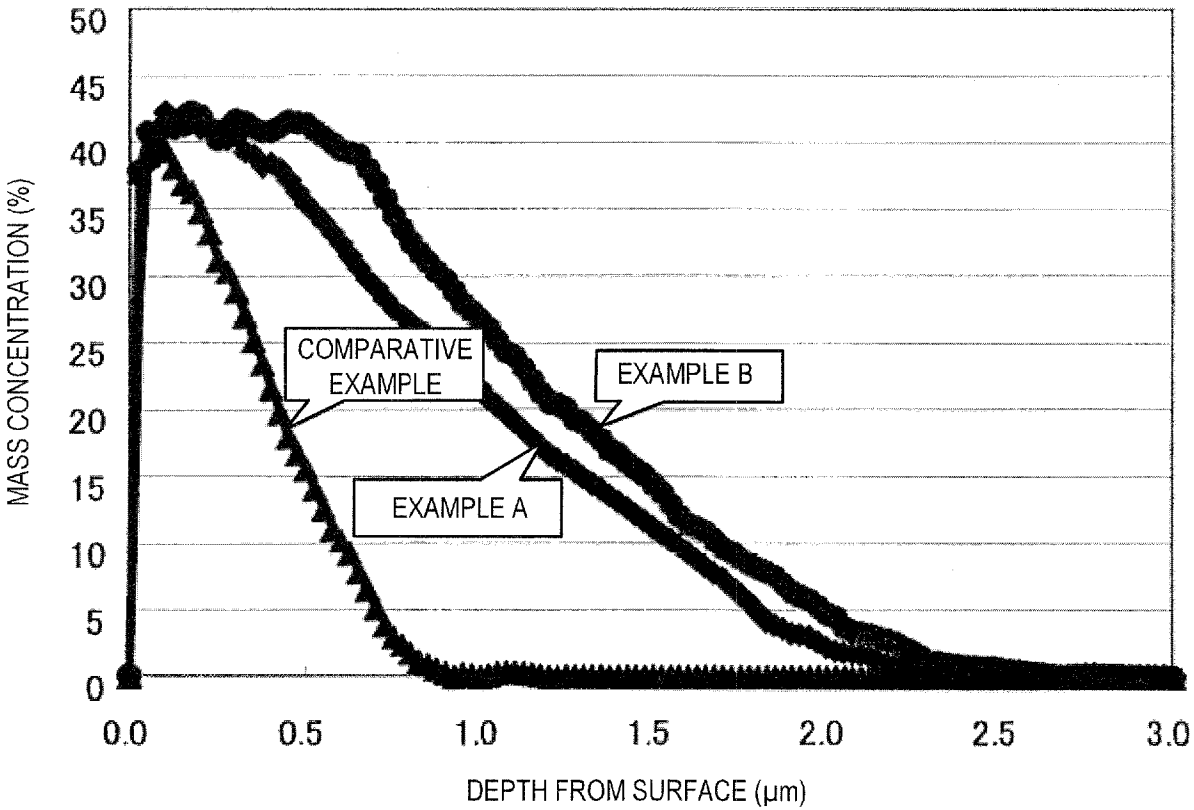
FIG. 3 is a chart illustrating results of analyses of fluorine concentration in a depth direction for test pieces made of SUS304.

FIG. 3 is a chart illustrating the results of analyses performed for measuring each thicknesses of the fluoride layers of the test pieces 4 and 4' before the respective fluoridation treatments of the comparative example, the example A, and the example B are performed.

In the comparative example, the example A, and the example B, two of the engine valves made of SUH35 arranged in each of nine sections of eight corners and one section near the center in the existing area of the workpieces inputted in the kiln are the thickness of the nitriding treatment layer of each stem portion of analyzed for their nitriding treatment layer thickness on each stem portion after the nitriding treatment. The results containing the value of variation within the kiln are listed in a table 1 below.

TABLE 1

| | Fluoride Layer Thickness before Fluoridation Treatment (μm) | $NF_3$ Gas Concentration in Fluoridation Treatment (vol. %) | Nitride Layer Thickness after Nitriding Treatment (μm) |
|---|---|---|---|
| Comparative Example | 0.7 | 3 | 0-12 |
| Example A | 1.8 | 1 | 20-25 |
| Example B | 2.0 | 1 | 15-23 |

Figure 4:
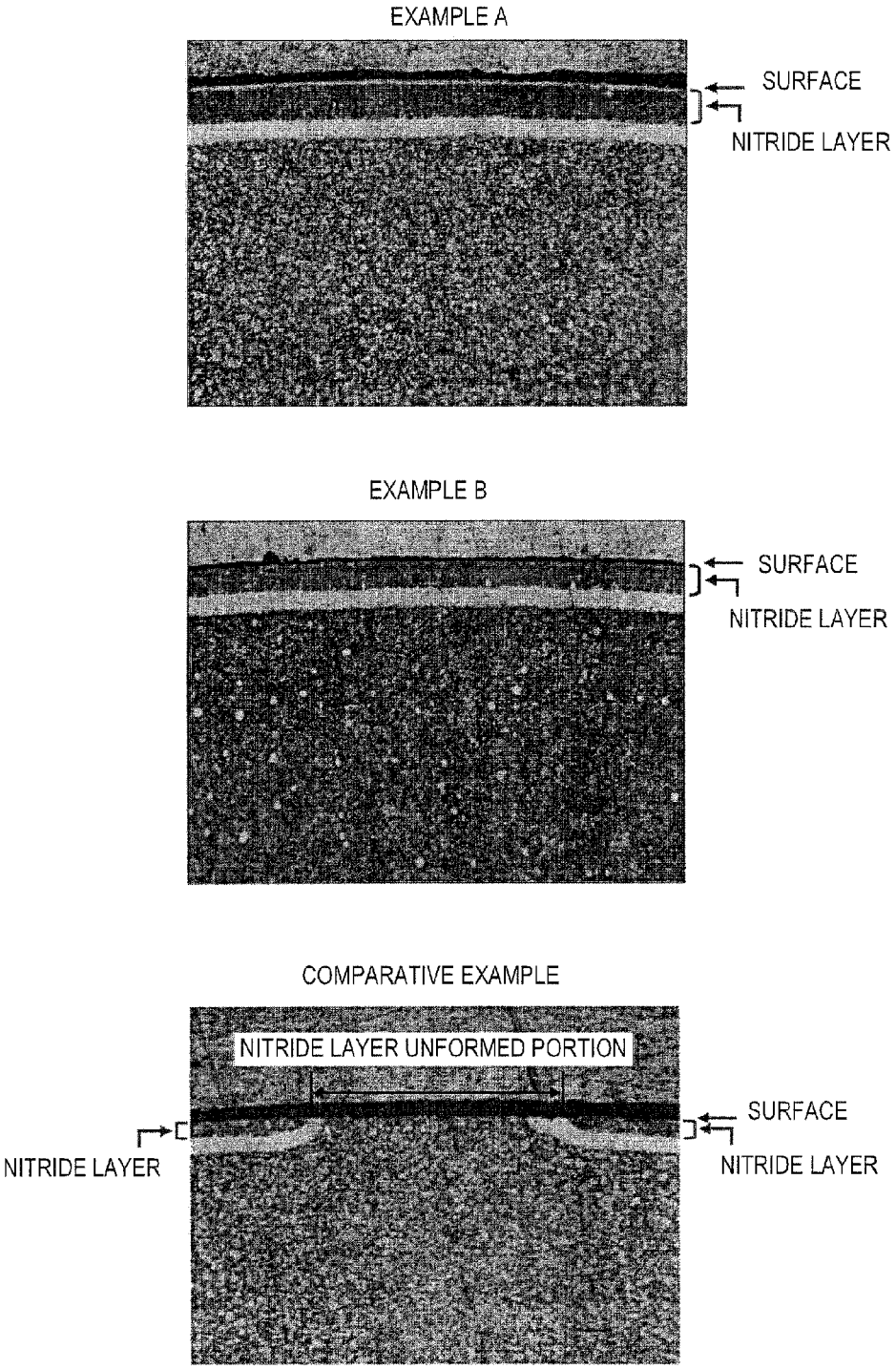
FIG. 4 illustrates cross-sectional grain structure of a stem portion of an engine valve made of SUH35.

FIG. 4 is views illustrating cross-sectional grain structure of representative portions of each of the surface part. The nitride layer thickness 0 in the table 1 above indicates that a portion where the nitride layer is not formed as illustrated in the photograph of a cross-section in the comparative example in FIG. 4 exists in the cross-section which is cut and observed.

As indicated in the table 1, the fluoride layer thicknesses on the surfaces of the test pieces 4 and 4' where the fluoridation concentration is 5 mass % or higher are 0.7 μm for the comparative example, 1.8 μm for the example A, and 2.0 μm for the example B. Based on these results, the fluoride layer thicknesses on the surfaces of the kiln walls 3 and 3' before the fluoridation treatment are estimated to be 0.7 μm for the comparative example, 1.8 μm for the example A, and 2.0 μm for the example B.

In the comparative example, the fluoridation treatment is performed while in the state where the fluoride layer formed on the kiln wall 3 in advance is thin. In the comparative example, although the concentration of $NF_3$ gas is comparatively higher than that of the examples A and B, the nitride layer thickness after the nitriding treatment is 0 through 12 μm which is comparatively thinner than that of the examples A and B. That is, it can be understood that, even though the sufficient decomposition and reaction of $NF_3$ gas occur within the fluoridation treatment kiln, an incomplete nitriding is caused. It can be assumed that the surface of the inner kiln structure such as the kiln wall 3 has taken priority over the workpiece in fluoridation reaction and a fluoride layer of a sufficient thickness failed to form on the workpiece surface, thereby a uniform nitride layer is not formed.

As described above, it can be understood that, if the sufficient fluoride layer is not formed on the surface of the kiln wall 3 as the comparative example, even if a means such as increasing the concentration of $NF_3$ gas is applied during the fluoridation treatment, it is difficult to form the uniform fluoride layer and nitride layer on the workpiece and, thus, a stable nitriding quality cannot be obtained.

On the other hand, as indicated in the cross-sectional photographs of the examples in FIG. 4, in the examples A and B in which the fluoridation treatment is performed in the state where the sufficient fluoride layer of the fluorine concentration of 5 mass % or higher, in which the fluoride layer thickness is 1.3 μm or thicker, is formed on the surfaces of the kiln walls 3 and 3', regardless of the decreased concentration of $NF_3$ gas relative to the comparative example during the fluoridation treatment of the workpiece, the uniform nitride layer is obtained in the entire surface in a cross-section of the stem portion cut and observed.

Further, in the example B where the kiln wall 3' has a cross-sectional shape of square, a problem such as the incomplete nitriding as the comparative example does not occur, and furthermore, it saves space thus leads to an advantage in the aspect of size-reduction of the unit. As for the embodiment A on the other hand, the kiln wall 3 has a cross-sectional shape of a circle, therefore, creating a smooth convectional gas flow within the kiln as indicated by the arrows in FIG. 1 and reducing variations in temperature and gas concentration in the kiln, and thus, leading to an improvement of nitriding quality by an improvement of fluoridation quality of the workpiece. Therefore, a cross-sectional shape of the kiln wall 3 is preferred to be a circle shape or an elliptic circle shape whose axis is arranged along the lateral axis against the blowing direction of the fan 9 for causing the convectional gas flow. It can also be understood from the results indicated in the table 1 that an extremely stable nitride layer can be formed considering also the variations within the kiln, in this way.

Further, it can be understood from the above results that, by attaching the test pieces 4 and 4' made of the same material as the inner surface of the kiln walls 3 and 3' and for verifying the states of the kiln walls 3 and 3' to the respective inner surfaces of the kiln walls 3 and 3' exposed within the fluoridation treatment space, so that the fluoride layer thickness formed on each of the surfaces can be verified, the fluoride layer thickness formed on the inner surfaces of the kiln walls 3 and 3' can be fairly accurately grasped. Furthermore, by having the test pieces 4 and 4' the same surface states as the kiln walls 3 and 3' not only in material but also, for example, the surface roughness, the states of the inside surfaces of kiln walls 3 and 3' can be more accurately grasped.

Example 2

Figure 5:
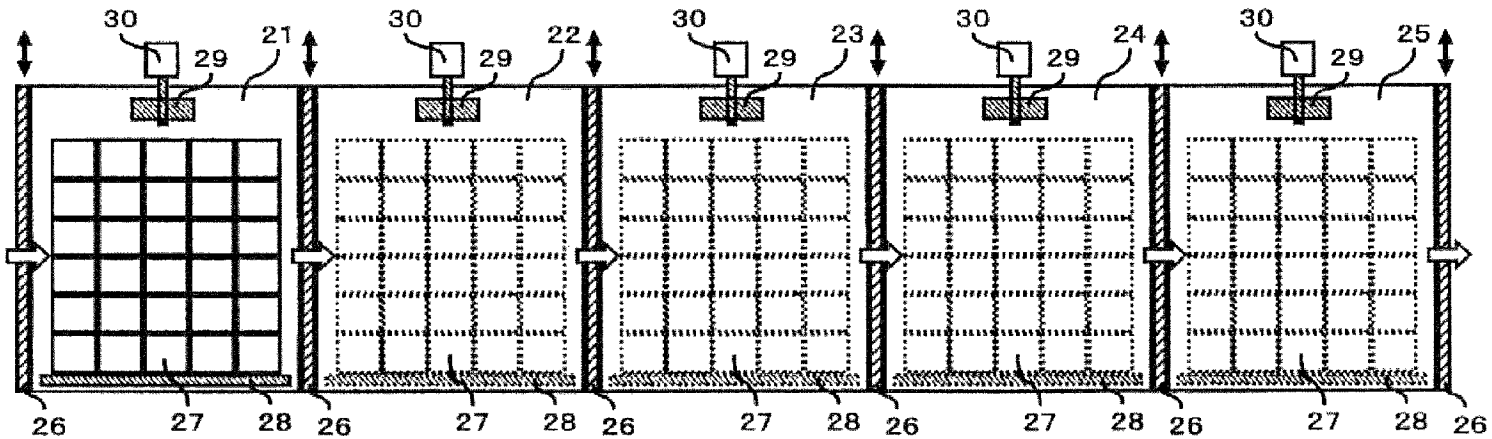
FIG. 5 is a schematic diagram illustrating a cross-sectional structure of a continuous heat-treatment kiln according to the present invention.

FIG. 5 illustrates a cross-sectional view of one example of a continuous heat treatment kiln that can perform a fluoridation treatment and a nitriding treatment.

This continuous heat treatment kiln includes a first treatment compartment 21 for performing a substitution of an atmosphere and a temperature raising in a state where a workpiece is loaded on a heat treatment jig 27, a second treatment compartment 22 which serves as a fluoridation treatment compartment for performing the fluoridation treatment above, a third treatment compartment 23 arranged between the second treatment compartment 22 and a fourth treatment compartment 24 and which serves as an intermediary compartment for preventing a fluoridation treatment gas and a nitriding treatment gas from mixing, and a fourth treatment compartment 24 which serves as a nitriding treatment compartment for performing the nitriding treatment after the fluoridation treatment, and a fifth treatment compartment 25 which serves as a cooling compartment for cooling the workpiece after the nitriding treatment. An opening-and-closing door 26 for automatically opening and closing are provided on an entrance side of the first treatment compartment 21, between the first through fifth treatment compartments 21 through 25, and on an exit side of the fifth treatment compartment 25.

An inside kiln stirring fan 29 for a homogenization of the temperature and the atmosphere is attached in each of an upper part of the treatment compartments 21, 22, 23, 24 and 25. Further, although not illustrated, in each of the compartments 21, 22, 23, 24 and 25, a piping for introducing and exhausting a gas for adjusting the atmosphere, a heating module for separately controlling the temperature of each of the compartments 21, 22, 23, 24 and 25, and a transporting module for moving a tray 28 loaded with the workpiece are attached. Further, another transporting module for transporting while the workpiece is loaded on the heat treatment jig 27 between the first treatment compartment 21, the second treatment compartment 22, the third treatment compartment 23, the fourth treatment compartment 24, and the fifth treatment compartment 25. In the figure, the reference numeral 30 is a driving motor for the fan 29.

In this unit, at first, the heat treatment jig 27 loaded with the workpiece is loaded on the tray 28 for transporting between the kilns. While the opening-and-closing door 26 provided before the first treatment compartment 21 for performing the atmosphere substitution and/or the temperature raising and for automatically opening and closing is raised, the tray 28 loaded with the heat treatment jig 27 is inserted into the kiln, and then the opening-and-closing door 26 is lowered and closed. Note that the door 26 has a structure that can keep a sufficient hermeticity on top of being able to automatically open and close. Next, by vacuuming and/or substituting with an $N_2$ gas, within the first treatment compartment 21, an oxidation of the workpiece surface when the temperature is raised is prevented.

In the first treatment compartment 21, it is important to perform the atmosphere substitution, and the temperature raising is not necessarily be performed; the temperature-raising may be performed in the second treatment compartment 22 which is the next compartment. A method of vacuuming for the moment by utilizing a vacuum pump may be used to expedite the atmosphere substitution, or a method of substituting the kiln inside gas simply by spinning the fan 29 to input, for example, the $N_2$ gas may be used. If performing the atmosphere substitution using these methods, that is sufficiently reducing an oxygen concentration and a moisture concentration within the first treatment compartment 21, which causes the oxidation, the temperature raising is not necessarily be performed. When the temperature is not raised, the heating module may not be provided to the first treatment compartment.

Next, after the opening-and-closing door 26 located between the first treatment compartment 21 and the second treatment compartment 22 is opened and the tray 28 loaded with the heat treatment jig 27 loaded with the workpiece is transported by the transporting module to the second treatment compartment 22 for performing the fluoridation treatment, the opening-and-closing door 26 is closed. In the second compartment 22, the fluoridation treatment is performed. Although the gas used for the fluoridation treatment is not limited as long as it contains a fluorine gas or a fluorine compound gas, a gas in which an $NF_3$ gas is diluted with, for example, the $N_2$ gas is the easiest to use from an ease of handling aspect. It is preferred to be progressed to the nitriding treatment as fast as possible after the fluoridation treatment. Therefore, after transporting the workpiece into the second treatment compartment 22, when the remaining treatment time in the second treatment compartment 22 becomes approximately the same as a fluoridation treatment time, the fluoridation gas is introduced and the fluoridation treatment is started.

As for the third treatment compartment 23 which functions as the intermediary compartment, the workpiece is inserted into the heat treatment kiln of the present invention at a virtually constant interval during the above described continuous operations and is transported through each of the treatment compartments 21, 22, 23, 24 and 25. In this case, because one of installation objectives of the third treatment compartment 23 is preventing the gas from mixing between the second treatment compartment 22 and the fourth treatment compartment 24, it is preferred to perform the fluoridation treatment in the second treatment compartment 22, maintain the temperature or perform no particular treatment in the third treatment compartment 23, and perform the nitriding treatment in the fourth treatment compartment 24. Here, it is desirable for the third treatment compartment 23 to be filled with an anti-oxidation gas, such as N2 gas, in its kiln inside atmosphere. When the third treatment compartment 23 is used for the above objective, the fan 29 and the motor 30 illustrated are not necessarily needed.

At this point, after the opening-and-closing door 26 located between the second treatment compartment 22 and the third treatment compartment 23 is opened and the tray 28 installed with the heat treatment jig 27 loaded with the workpiece is transported by the transporting module to the third treatment compartment 23, the opening-and-closing door 26 is closed. Further, in the state where the heat treatment jig 27 remains installed while the workpiece is loaded therein, after the opening-and-closing door 26 located between the third treatment compartment 23 and the fourth treatment compartment 24 is opened and the tray 28 is transported by the transporting module to the fourth treatment compartment 24, the opening-and-closing door 26 is closed.

Next, the fluoridation treated workpiece is then transported to the fourth treatment compartment 24 which functions as the nitriding treatment compartment and the process of nitriding treatment is performed. Also for the fourth treatment compartment 24, keeping at the temperature for the nitriding treatment therein in advance contributes to a reduction of treatment time. Note that there is no particular limitation for, the temperature and time frame of performing the nitriding treatment and the like because they change depending on, for example, the material and the desired performance of the workpiece.

Next, the nitridation treated workpiece in the fourth treatment compartment 24 is, by opening the opening-and-closing door 26 located between the fourth treatment compartment 24 and the fifth treatment compartment 25, transported by the transporting module to the fifth treatment compartment 25, and the door 26 is closed to cool the workpiece. Here, the atmosphere within the fifth treatment compartment 25 which functions as a cooling compartment is desirable to be filled with the anti-oxidation gas, such as the $N_2$ gas, so as to prevent strength degradation due to an excessive oxidation of the surface of the nitriding treated workpiece. After the cooling is completed, the opening-and-closing door 26 of the exit side of the fifth treatment compartment 25 is opened, and the tray 28 is transported outside the kiln.

In this example, NCF600 is used as the material for the surface of the kiln interior structure such as kiln walls of the second treatment compartment 22 which is the fluoridation treatment compartment and the fourth treatment compartment 24 which is the nitriding treatment compartment. Further, although not illustrated, on the inside surface of the kiln wall exposed within the treatment space of the second treatment compartment 22 which is the fluoridation compartment, a test piece made of the same material and has the same surface roughness as the kiln wall, and for verifying a kiln wall state is detachably attached. Note that, as for the kiln wall shape, the cross-sectional shape of both the fluoridation treatment compartment and the nitriding treatment compartment is a circle shape as illustrated in FIG. 1 toward the progressing direction of the workpiece. That is, the kiln wall shape of the fluoridation treatment compartment and the nitriding treatment compartment is a cylindrical shape.

An auxiliary fluoridation treatment is performed in which, after raising the temperature within the second treatment compartment 22 which is the fluoridation treatment compartment of the continuous heat treatment kiln to 450° C., the compartment is kept in an atmosphere containing 10 vol. % of the $NF_3$ gas for 180 minutes without any workpiece inputted therein, and a fluoride layer having the fluorine concentration of 5 mass % or higher with a thickness of 0.6 μm is formed on the kiln wall surface.

Next, the heat treatment jig 27 is placed with a total of 5000 engine valves made of NCF718, which are the workpieces, loaded on the transportation tray 28, and inserted by opening the opening-and-closing door 26 on the entrance side of the first treatment compartment 21 into the first treatment compartment 21 which serves as a gas substitution compartment for mainly preventing the oxidation of workpieces. Note that, the first treatment compartment 21 is further configured to be able to perform, for example, an auxiliary temperature raising after the gas substitution so as to adjust the cycle time at each treatment compartment, besides the function as the gas substitution compartment.

After inside the first treatment compartment 21 is substituted by nitrogen, a fluoridation treatment is performed by transporting the workpiece to the second treatment compartment 22, which is substituted by nitrogen and kept at 450° C. in advance, raising the temperatures of the workpieces to 450° C. and keeping for 30 minutes in an atmosphere containing 5 vol. % of $NF_3$ gas.

After the fluoridation treatment above, the workpieces are transported to the third treatment compartment 23, and, then, transported to the fourth treatment compartment 24 which functions as the nitriding compartment. In so called the continuous operations where the introduction into the continuous kiln and the treatment of the workpieces are continuously performed, the fluoridation treatment implemented in the second treatment compartment 22 and the nitriding treatment implemented in the fourth treatment compartment 24 are to be performed simultaneously. Because there is a danger that the fluorine gas and the nitrogen gas are mixed here and causes an un-necessary reaction, the third treatment compartment 23 is desired to be arranged as the intermediary compartment having a main object in preventing such an occurrence, and to be normally filled with an inert gas such as the $N_2$ gas.

Providing the third treatment compartment 23 which functions as the intermediary compartment leads to an improvement of productivity in addition to the adjustment of the cycle time during the continuous treatments, therefore it leads to a further preferred configuration in the kiln for the continuous treatments including the fluoridation treatment. The third treatment compartment 23 does not need to perform any particular treatment, however, when the workpieces stayed long in the third treatment compartment 23 due to a circumstance in cycle time in each treatment compartment, the third treatment compartment 23 can have a function as a compartment for maintaining or raising the temperatures of the workpieces so as to prevent the temperature raising time frame in the fourth treatment compartment 24 which is the next compartment from extending.

Next, the nitriding treatment is performed by raising the temperatures of the workpieces transported to the fourth treatment compartment 24 which is maintained at 590° C. in advance to 590° C. while a gas is introduced so that the $NH_3$ gas and the $N_2$ gas have 5:5 ratio in volume, then, introducing the adjusted gas to the fourth treatment compartment 24 so that the $NH_3$ gas and an RX gas have 5:5 ratio in volume, and keeping for 2 hours.

Then, the tray 28 loaded with the workpieces is transported to the fifth treatment compartment 25 which functions as the cooling compartment, and, when the temperatures of the workpieces are cooled to be 100° C. or lower within the $N_2$ gas atmosphere, the opening-and-closing door 26 on the exit side of the fifth treatment compartment 25 is opened, and the workpieces are taken out from the continuous heat treatment kiln to be cooled to the room temperature.

After the auxiliary fluoridation treatment described above is performed, the continuous heat treatments including the fluoridation treatment and the nitriding treatment are performed repeatedly. Note that, the quantity of the engine valves 5 is increased by 1.5 times for the sixth treatment, 0.5 times for the seventh treatment, and 1.2 times for the eighth treatment.

Figure 6:
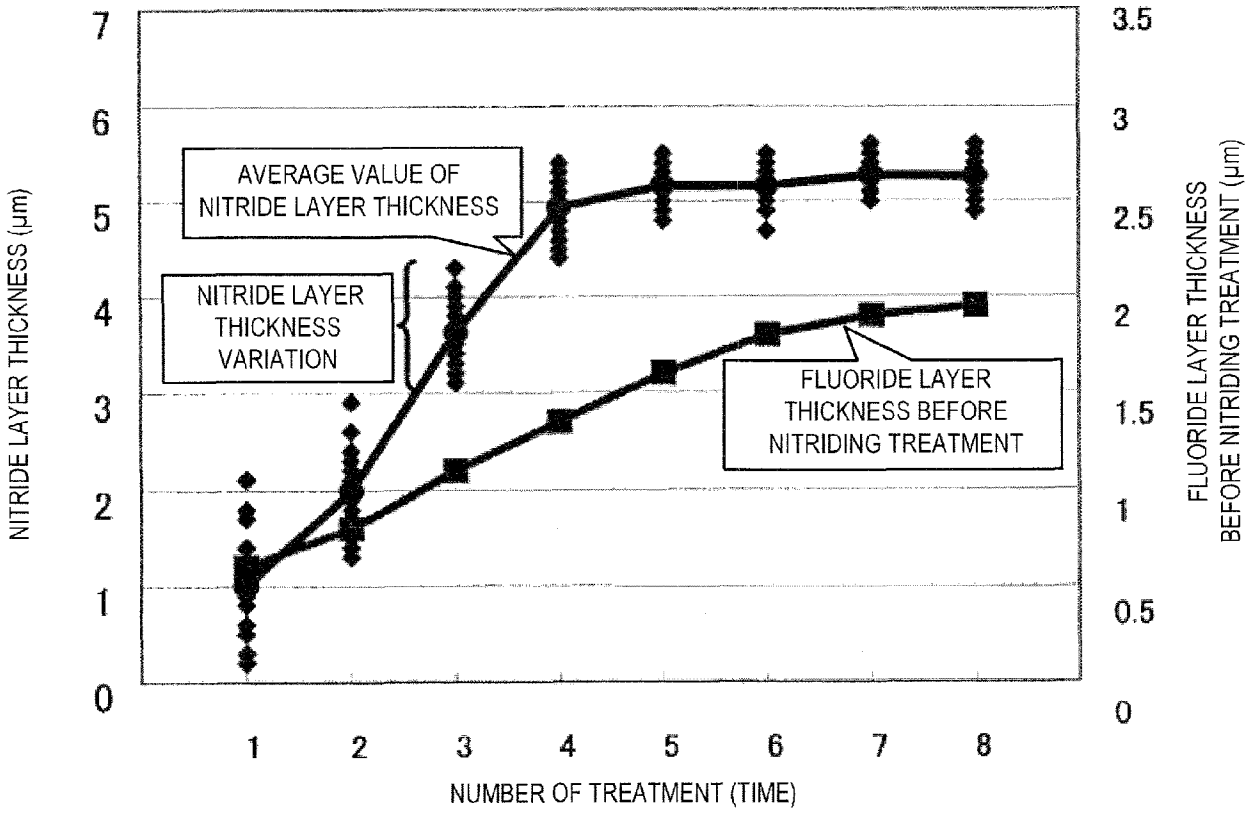
FIG. 6 is a chart illustrating the thickness of a nitride layer and the thickness of a fluoride layer prior to a nitriding treatment of a stem portion of an engine valve made of NCF718.

The treatment results of each of the treatments from the first treatment to the eighth treatment here are indicated in a table 2 and FIG. 6. The table 2 and FIG. 6 indicate the results in which, by sampling two of the engine valves made of NCF718 arranged in each of nine sections of eight corners and one section near the center, the nitriding treatment layer thickness on each of stem portions of the sampled engine valves, and the thickness of the fluoride layer where the fluorine concentration is 5 mass % or higher on the surface of the test piece attached within the second treatment space 22 prior to each continuous heat treatment are measured.

TABLE 2

| Number of Treatment | Fluoride Layer Thickness before Fluoridation Treatment (μm) | Nitride Layer Thickness after Nitriding Treatment (μm) | Nitride Layer thickness Variation (μm) |
|---|---|---|---|
| 1 | 0.6 | 0.2-2.1 | 1.9 |
| 2 | 0.8 | 1.3-2.9 | 1.6 |
| 3 | 1.1 | 3.1-4.3 | 1.2 |
| 4 | 1.35 | 4.4-5.4 | 1.0 |
| 5 | 1.6 | 4.8-5.5 | 0.7 |
| 6 | 1.8 | 4.7-5.5 | 0.8 |
| 7 | 1.9 | 5.0-5.6 | 0.6 |
| 8 | 1.95 | 4.9-5.6 | 0.7 |

As shown in FIG. 6 and the table 2, it can be understood that, by repeating the treatment, the fluoride layer on the surface of the test piece, that is, the surface of the kiln wall becomes thicker, and correspondingly, the nitride layer thickness becomes thicker and the nitride layer thickness variation becomes smaller. Further, it can be understood that, when the fluoride layer thickness becomes approximately 1.3 μm or thicker, the nitride layer thickness variation and the nitride layer thickness itself become stable. Thus, it can be understood that, in addition to the results from the example 1, even when the kiln wall material is changed, as long as the fluoride layer where the fluorine concentration is 5 mass % or higher has the thickness of 1.3 μm or thicker, the stable fluoridation treatment can be performed, and, correspondingly, the stable nitriding treatment can be performed.

Further, even after the sixth time of the repetitive treatments where the quantity of the workpiece is varied, no significant variation is seen in the nitride layer thickness and the average value of the nitride layer thicknesses. That is, it can be understood that, even when the loaded quantity of the workpiece is varied to some extent, as long as the fluoride layer thickness on the kiln wall is sufficient, the stable fluoridation treatment can be performed, and, also in the nitriding treatment performed afterwards, and the stable nitriding quality can be maintained without significantly affecting, such as, the nitride layer thickness.

Example 3

By continuously utilizing the continuous heat treatment kiln above, a total of 5000 engine valves made of SUH11 are inputted in the heat treatment jig 27. After the substitution by an $N_2$ gas in the first treatment compartment 21, the tray 28 loaded therewith is transported to the second treatment compartment 22 heated to 450° C. in advance, so that the temperatures of the workpieces are raised, and is maintained for 300 minutes without supplying the $NF_3$ gas. Then, the workpieces are cooled without performing the nitriding treatment, and taken out of the kiln.

The thickness of the fluoride layer where the fluorine concentration is 5 mass % or higher on the surface of the test piece attached in the inside surface of the kiln wall is reduced from approximately 2.0 μm to approximately 1.2 μm by this treatment. At this point, fluoride layers of approximately 0.4 to 0.6 μm thickness are verified to be formed on surfaces of the engine valves made of SUH11. That is, it can be understood that, even when the $NF_3$ gas is not supplied as described above, the fluoride layer can be formed on the surface of the workpiece.

From this, it can be understood that, when the workpieces are heated and kept in a state where the $NF_3$ gas less than a suitable amount under a certain fluoridation treatment condition is supplied to the fluoridation treatment compartment, the fluorine source is released from the fluoride layer on the kiln wall, thereby the surface of workpiece is fluoridated, and the fluoride layer thickness on the kiln wall reduces correspondingly.

Next, a fluoridation treatment is performed, in which, without any workpiece loaded in the second treatment compartment 22, an atmosphere containing 5 vol. % of $NF_3$ gas is kept for 30 minutes. Here, the thickness of the fluoride layer where the fluorine concentration is 5 mass % or higher on the surface of the test piece has only increased to approximately 1.3 μm.

Subsequently, a fluoridation treatment is performed, in which the engine valves made of SUH11 are kept for 30 minutes in the atmosphere containing 5 vol. % of $NF_3$ gas within the second treatment compartment 22. Here, the thickness of the fluoride layer where the fluorine concentration is 5 mass % or higher on the surface of the test piece has restored to approximately 1.6 μm. The results are illustrated in the table 3 below.

TABLE 3

| | Fluoride Layer Thickness before Fluoridation Treatment (μm) | Workpiece Load during Fluoridation Treatment | Fluoride Layer Thickness after Fluoridation Treatment (μm) | Increase Amount of Layer Thickness in Fluoridation treatment (μm) |
|---|---|---|---|---|
| Comparative Example | 1.2 | None | 1.3 | 0.1 |
| Example | 1.3 | Yes | 1.6 | 0.3 |

Based on the above results, it can be understood that, when the fluoride layer thickness on the surface of the kiln wall becomes thin, in order to recover the fluoride layer thickness, the recovery is performed more effectively and faster in the method of performing the auxiliary fluoridation in the state where some kind of workpiece is loaded, and, thus, the recovery efficiency is high. The workpiece to be loaded at the time of the auxiliary fluoridation treatment as a recovery treatment, a various states of workpiece can be used such as what has the fluoride layer as described above, or what is nitriding treated, as well as what is nitrided or oxidized and, in addition, shot-blasting treated or barrel treated.

Next, by utilizing a continuous heat treatment kiln the thickness of the fluoride layer on the surface of the kiln wall of the second treatment compartment 22 where the fluorine concentration is 5 mass % or higher is 1.6 μm, a fluoridation treatment is performed in the second treatment compartment 22, in which, in a state where a total of 5000 engine valves made of NCF718 are loaded, it is kept at 450° C. for 30 minutes in the atmosphere containing 5 vol. % of $NF_3$ gas. Further, a nitriding treatment is performed in the fourth treatment compartment 24, in which the temperature is raised to 590° C. while introducing a gas so that the $NH_3$ gas and the $N_2$ gas have 5:5 ratio in volume, and then, while introducing a gas so that the $NH_3$ gas and the RX gas have 5:5 ratio in volume, the temperature is kept for 2 hours. As a result, the nitride layer thickness and its variation on the stem portions of the engine valves are in the same level as the results after the fifth time of the repetitive treatments as illustrated in FIG. 6.

As described above, it can be understood that even when the thickness of the fluoride layer where the fluorine concentration is 5 mass % or higher on the surface of the kiln wall becomes less than 1.3 μm, the fluoride layer can be easily restored to be 1.3 μm or thicker by performing the auxiliary fluoridation treatment properly, thus the stable nitriding treatment can continuously be performed.

Based on these results, forming the fluoride layer where the fluorine concentration is 5 mass % or higher with a thickness of 1.3 μm or thicker on the surface of the kiln wall of the fluoridation treatment kiln leads to a fluoridation treatment kiln that can stably form the target fluoride layer even when a change in quantity of workpiece occurs. Further, in the continuous heat treatment kiln including the fluoridation treatment compartment, forming the fluoride layer where the fluorine concentration is 5 mass % or higher with a thickness of 1.3 μm or thicker on the surface of the kiln wall of the fluoridation treatment compartment leads to a continuous heat treatment kiln that can maintain a stable nitriding quality, such as nitride layer thickness, on top of a high productivity. Furthermore, by using the virtually cylindrical shape for the shape of the kiln wall, the convectional gas flow becomes smooth, and the homogenization of a heat distribution and gas concentration within the kiln is improved, thereby the nitriding quality if further improved, and, thus, leading to a further suitable heat treatment kiln.

INDUSTRIAL APPLICABILITY

By utilizing a fluoridation treatment kiln for performing a fluoridation treatment on metallic materials or a continuous heat treatment kiln including a fluoridation treatment compartment, even when, for example, a quantity of a workpiece changes significantly, a stable fluoridation treatment can be performed and, further, a nitriding treatment of a stable quality can be performed continuously, thus the kiln can suitably be utilized for the fluoridation treatment and the nitriding treatment of, for example, mechanical components including precision components.

DESCRIPTION OF REFERENCE NUMERALS

1, 1': Kiln Body
2, 2': Heater
3, 3': Kiln Wall
4, 4': Test Piece
5, 5': Engine Valve (Workpiece)
6, 6': Roller
7, 7': Tray
8, 8': Heat Treatment Jig
9, 9': Fan
10, 10': Motor
21: First Treatment Compartment (Atmosphere Substitution and/or Temperature Raising Compartment)
22: Second Treatment Compartment (Fluoridation Treatment Compartment)
23: Third Treatment Compartment (Intermediary Compartment)
24: Fourth Treatment Compartment (Fluoridation Treatment Compartment)
25: Fifth Treatment Compartment (Cooling Compartment)
26: Opening-and-Closing Door
27: Heat Treatment Jig
28: Tray
29: Fan
30: Motor

What is claimed is:

1. A method of fluoridation, for performing a fluoridation treatment by heating and keeping a workpiece which is made from a metallic material in a fluoridation treatment space filled with a predetermined fluoride atmosphere, comprising:

exposing an interior space structure and a fluoride layer formed in advance on a surface within the fluoridation treatment space filled with the predetermined fluoride atmosphere; and performing the fluoridation treatment on the workpiece by releasing a fluoridation source gas from the fluoride layer on the surface within the fluoridation treatment space, while approximately maintaining a predetermined fluoride atmosphere in the treatment space when a fluoridation potential of the fluoride atmosphere during the fluoridation treatment is insufficient.

2. The method of fluoridation of claim 1, wherein the fluoride layer formed in advance on the surface of the interior space structure has a thickness of 1.3 μm or thicker in a portion where a fluorine concentration is 5 mass % or higher.

3. The method of fluoridation of claim 1, wherein the fluoride layer formed at least in a section where its temperature becomes higher than the workpiece during the fluoridation treatment has a thickness of 1.3 μm or thicker in a portion where a fluorine concentration is 5 mass % or higher.

4. Directions for use of a unit of fluoridation for performing a fluoridation treatment by heating and keeping a workpiece which is made from a metallic material in a fluoridation treatment space filled with a predetermined fluoride atmosphere, the unit of fluoridation performing the fluoridation treatment on the workpiece in a state where an interior space structure and a fluoride layer formed in advance on a surface within the fluoridation treatment space are exposed within the fluoridation treatment space filled with the predetermined fluoride atmosphere, wherein, when an fluorine amount of the fluoride layer formed in advance on the surface of the interior space structure falls below a predetermined amount, the fluoride layer is restored by performing an auxiliary fluoridation treatment by heating and keeping inside the fluoridation treatment space with a predetermined atmosphere, the fluoridation treatment comprising the step of releasing a fluoridation source gas from the fluoride layer on the surface within the fluoridation treatment space, while approximately maintaining a predetermined fluoride atmosphere in the treatment space when a fluoridation potential of the fluoride atmosphere during the fluoridation treatment is insufficient.

5. The directions for use of the unit of fluoridation of claim 4, wherein a test piece made of the same material as a material constituting the surface of the interior space structure is arranged within the fluoridation treatment space, and, after the fluoridation treatment is performed repeatedly, the fluorine amount of the fluoride layer formed on the surface of the interior space structure is detected based on a state of the test piece.

6. A method of fluoridation, for performing a fluoridation treatment by heating and keeping a workpiece in a fluoridation treatment space filled with a predetermined fluoride atmosphere, comprising:

exposing an interior space structure within the fluoridation treatment space;

forming a fluoridate layer in advance on a surface of the interior space structure exposed within the fluoridation treatment space; and performing the fluoridation treatment by placing the workpiece in the fluoridation treatment space such that fluoridation source gas is released from the fluoride layer to treat the workpiece.

* * * * *